US009543705B2

(12) United States Patent
Wu et al.

(10) Patent No.: US 9,543,705 B2
(45) Date of Patent: Jan. 10, 2017

(54) ELECTRICAL CONNECTOR HAVING IMPROVED CHARACTERISTIC IMPEDANCE

(71) Applicant: HON HAI PRECISION INDUSTRY CO., LTD., New Taipei (TW)

(72) Inventors: Jerry Wu, Irvine, CA (US); Jun Chen, Kunshan (CN); Zhuang-zhi Wu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/259,394

(22) Filed: Apr. 23, 2014

(65) Prior Publication Data

US 2014/0315440 A1 Oct. 23, 2014

(30) Foreign Application Priority Data

Apr. 23, 2013 (CN) ..... 2013 1 0142022

(51) Int. Cl.

| | |
|---|---|
| ***H01R 33/00*** | (2006.01) |
| ***H01R 13/6473*** | (2011.01) |
| *H01R 13/405* | (2006.01) |
| *H01R 13/506* | (2006.01) |
| *H01R 24/20* | (2011.01) |

(52) U.S. Cl.

CPC ..... *H01R 13/6473* (2013.01); *H01R 13/405* (2013.01); *H01R 13/506* (2013.01); *H01R 24/20* (2013.01)

(58) Field of Classification Search

CPC ..... H01R 12/585; H01R 12/724; H01R 12/79; H01R 13/514; H01R 13/2442; H01R 13/405; H01R 13/506; H01R 13/6473; H01R 23/7073; H01R 23/7068; H01R 24/20; H01R 24/76

USPC ..... 439/101, 108, 620.09, 626, 630, 637, 439/660, 733.1, 751; 29/844, 629

See application file for complete search history.

(56) References Cited

U.S. PATENT DOCUMENTS

| | | | | |
|---|---|---|---|---|
| 4,045,868 A * | 9/1977 | Ammon et al. | ..... | 29/845 |
| 4,737,118 A * | 4/1988 | Lockard | ..... | H01R 23/27 439/293 |
| 4,966,557 A * | 10/1990 | Barkus | ..... | H01R 13/6315 439/246 |
| 5,046,960 A * | 9/1991 | Fedder | ..... | H01R 23/688 439/108 |
| 5,286,212 A * | 2/1994 | Broeksteeg | ..... | 439/108 |

(Continued)

FOREIGN PATENT DOCUMENTS

| | | |
|---|---|---|
| CN | 102055087 | 5/2011 |
| CN | 102263335 | 11/2011 |

(Continued)

*Primary Examiner* — Amy Cohen Johnson
*Assistant Examiner* — Milagros Jeancharles
(74) *Attorney, Agent, or Firm* — Wei Te Chung; Ming Chieh Chang

(57) ABSTRACT

An electrical connector (10) includes an insulative housing (20) and a number of terminals received in the insulative housing (20). Each terminal includes an engaging portion (54) for mating with a mating connector, a middle portion (56) interconnected with the engaging portion (54), and a soldering portion (55) interconnected with the middle portion (56). A dimension of the middle portion (56) in a thickness direction is greater than a dimension of the engaging portion (54) in the thickness direction.

7 Claims, 7 Drawing Sheets

(56) References Cited

U.S. PATENT DOCUMENTS

| | | | | |
|---|---|---|---|---|
| 5,632,634 | A * | 5/1997 | Soes | H01R 13/65807 439/101 |
| 5,993,268 | A * | 11/1999 | Yamaguchi | H01R 13/432 439/746 |
| 6,953,351 | B2 | 10/2005 | Fromm et al. | |
| 7,591,655 | B2 | 9/2009 | Fedder et al. | |
| 7,744,403 | B2 * | 6/2010 | Barr | H01R 24/568 439/499 |
| 8,333,619 | B2 * | 12/2012 | Kondo | H01R 13/6474 439/676 |
| 8,382,524 | B2 | 2/2013 | Khilchenko et al. | |
| 8,840,321 | B2 * | 9/2014 | Wu | 385/89 |

FOREIGN PATENT DOCUMENTS

| | | |
|---|---|---|
| CN | 202050096 | 11/2011 |
| CN | 202513384 | 10/2012 |
| TW | 439294 | 10/2012 |

* cited by examiner

ELECTRICAL CONNECTOR HAVING IMPROVED CHARACTERISTIC IMPEDANCE

BACKGROUND OF THE INVENTION

1. Field of the Invention

The present invention relates to an electrical connector, and more particularly to an electrical connector with high speed signal transmission.

2. Description of Prior Arts

A conventional electrical connector comprises an insulative housing and a plurality of terminals received in the insulative housing. The terminal comprises an engaging portion, a soldering portion, and a middle portion interconnected between the engaging portion and the soldering portion. The engaging portion is used for mating with a mating terminal. The soldering portion is used for soldering with a wire. When the engaging portion is mated with the mating terminal, a combined dimension of the engaging portion and the mating terminal in a thickness direction will be greater than a dimension of the middle portion in the thickness direction. When the soldering portion is soldered with the wire, a combined dimension of the soldering portion and the wire in the thickness direction is also greater than the dimension of the middle portion in the thickness direction. So, when the terminal of the electrical connector is mated with the mating terminal and is soldered with the wire, a characteristic impedance of the terminal may have an abrupt change. This could make the transmission of signals unstable.

An electrical connector with stable signal transmission is desired.

SUMMARY OF THE INVENTION

An electrical connector comprises an insulative housing and a plurality of terminals received in the insulative housing. Each terminal comprises an engaging portion for mating with a mating connector, a middle portion interconnected with the mating portion, and a soldering portion interconnected with the middle portion. A dimension of the middle portion in a thickness direction is greater than a dimension of the engaging portion in a thickness direction.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
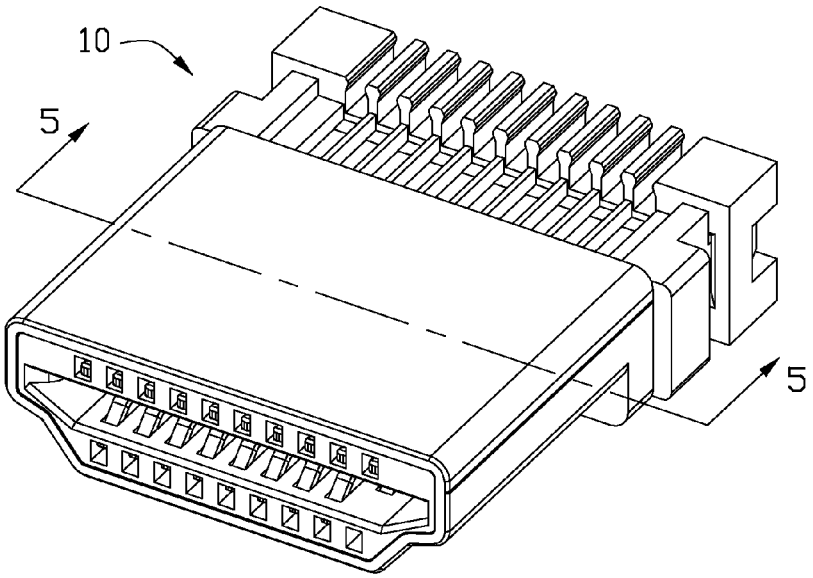
FIG. 1 is a perspective view of an electrical connector in accordance with the present invention.
Figure 2:
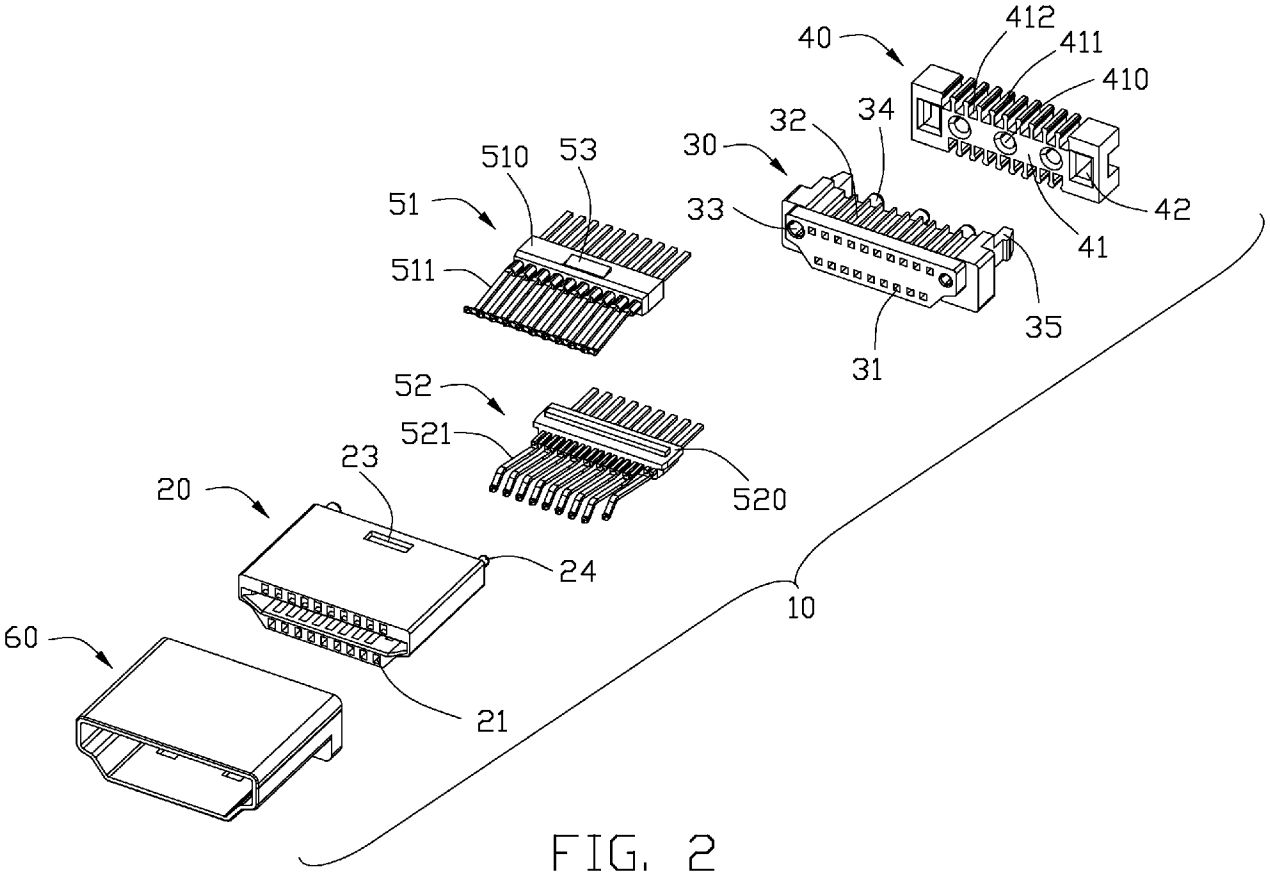
FIG. 2 is an exploded view of the electrical connector as shown in FIG. 1.
Figure 3:
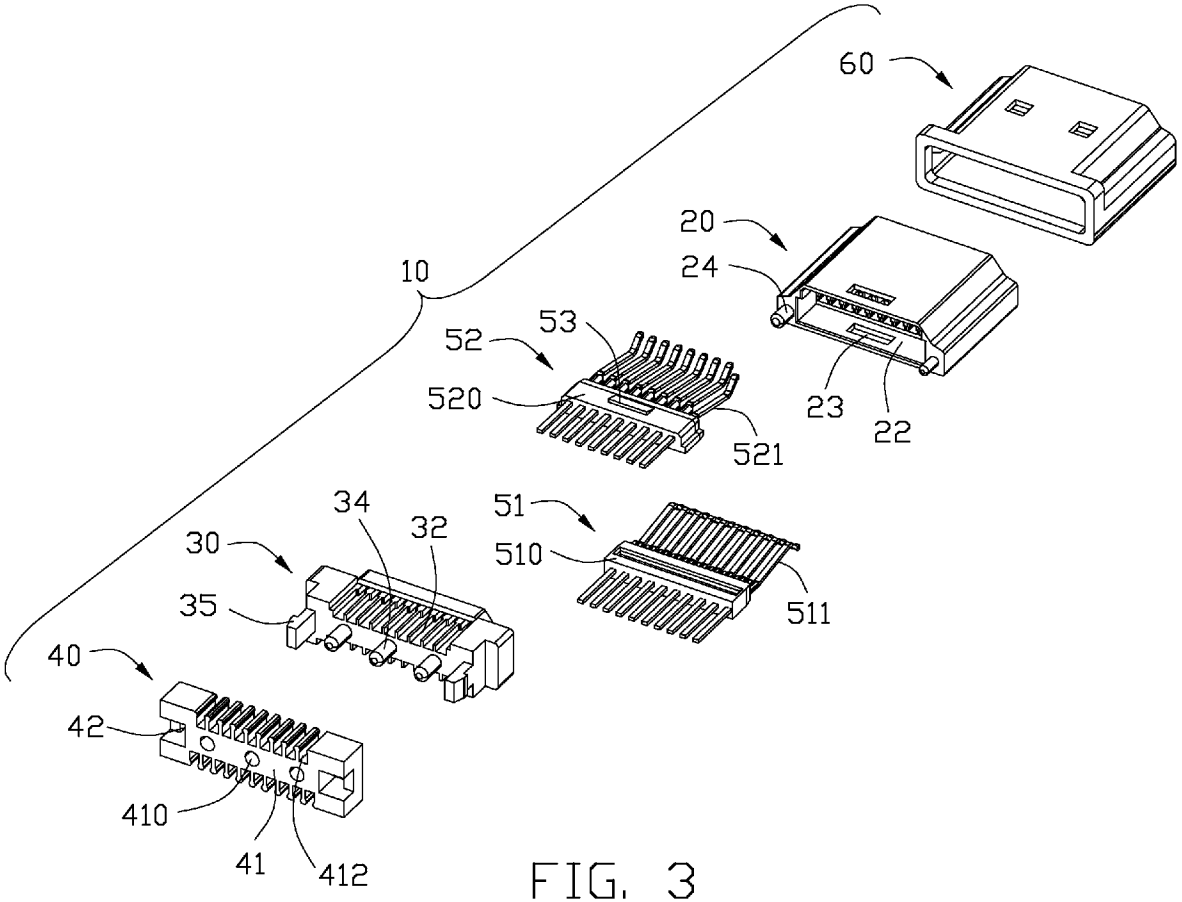
FIG. 3 is another exploded view of the electrical connector as shown in FIG. 2.
Figure 4:
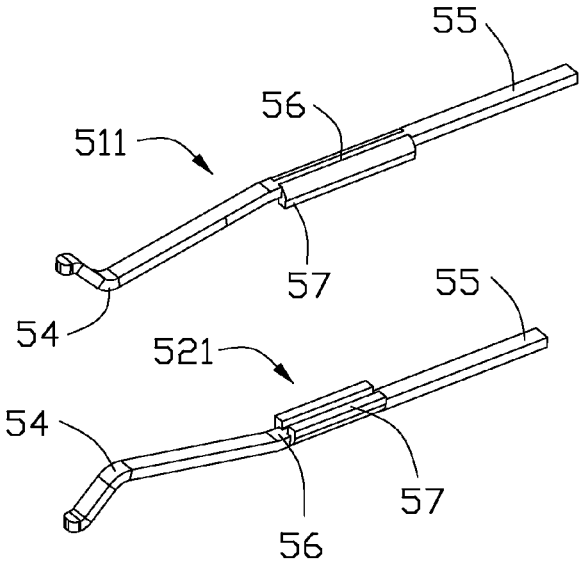
FIG. 4 is a perspective view of the terminals of the electrical connector as shown in FIG. 3.
Figure 5:
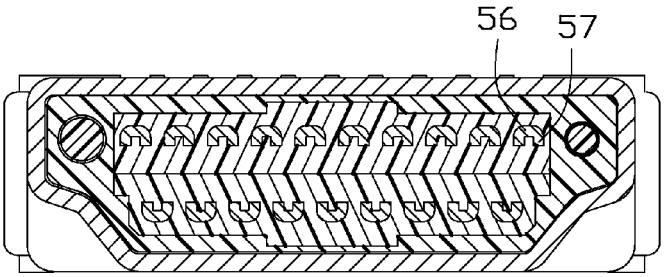
FIG. 5 is a cross-sectional view of the electrical connector taken along line 5-5 of FIG. 1.

Reference will now be made to the drawing figures to describe the present invention in detail.

Referring to FIGS. 1-5 show an electrical connector 10 adapted for mating with a mating connector, comprises an insulative housing 20, a terminal module, an insulator 30, a wire receiving block 40, and a shell 60 covering the insulative housing 20. The terminal module is mounted to the insulative housing 20 along a rear-to-front direction. The insulator 30 is mounted to the insulative housing 20 along the rear-to-front direction. The wire receiving block 40 is mounted to the insulator 30 along the rear-to-front direction.

The insulative housing 20 has a front face and a rear face. The insulative housing 20 defines a first receiving cavity extending rearwardly from the front face. The insulative housing 20 comprises a second receiving cavity 22 extending frontwardly from the rear face. Each of the upper inner face and the lower inner face of the first receiving cavity defines a plurality of terminal receiving slots 21. The terminal receiving slots 21 are in communication with the second receiving cavity 22. Each of an upper face and a lower face of the insulative housing 20 defines a holding hole 23 in communication with the second receiving cavity 22. The insulative housing 20 comprises two first posts 24 extending rearwardly from the rear face, the first posts 24 having different dimensions and being disposed in two sides of the second receiving cavity 22, respectively.

The terminal module comprises a first terminal module 51 and a second terminal module 52. The first terminal module 51 is mounted to the second terminal module 52 along a top-to-bottom direction. The first terminal module 51 comprises a first insulative block 510 and a plurality of first terminals 511 integrated with the first insulative block 510. The second terminal module 52 comprises a second insulative block 520 and a plurality of second terminals 521 integrated with the second insulative block 520. Each of an upper face of the first insulative block 510 and a lower face of the second insulative block 520 comprises a projection 53. The terminal module is mounted to the insulative housing 20 along a rear-to-front direction and is received in the second receiving cavity 22. The projections 53 are received in the holding holes 23, respectively. Each of the first terminals 511 and the second terminals 521 comprises an engaging portion 54 for mating with a mating terminal of the mating connector, a middle portion 56 interconnected with the engaging portion 54, and a soldering portion 55 interconnected with the middle portion 56. The engaging portions 54 of first terminals 511 and the second terminals 521 are received in the terminal receiving slots 21, respectively. The middle portion 56 of the first terminals 511 is integrated with the first insulative block 510. The middle portion 56 of the second terminals 521 is integrated with the second insulative block 520. The first terminal 511 comprises two prominences 57 extending downwardly from two sides of the middle portion 56, respectively. The second terminal 521 comprises two prominences 57 extending upwardly from two sides of the middle portion 56, respectively. Therefore, a dimension of the middle portion in a thickness direction is greater than a dimension of the engaging portion in the thickness, and the dimension of the middle portion in the thickness direction is greater than a dimension of the soldering portion in the thickness direction.

The insulator 30 is mounted to the insulative housing 20 along a rear-to-front direction. The front face of the insulative housing 20 defines a row of upper holes 31 and a row of lower holes 31. Each of an upper face and a lower face of the insulator 30 defines a plurality of terminal mounting slots 32. The upper holes 31 and the lower holes 31 are in communication with the terminal mounting slots 32, respectively. The soldering portions 55 of the first terminals 511 extend rearwardly from the upper holes 31 and are received in the terminal mounting slots 32, respectively. The soldering portions 55 of the second terminals 521 extend rearwardly from the lower holes 31 and are received in the terminal mounting slots 32, respectively. A front face of the insulator 30 defines two first receiving holes 33 having different dimensions. The receiving holes 33 are disposed in two sides of the upper holes 31 and the lower holes 31, respectively. The two first posts 24 of the insulative housing 20 are received in the two first receiving holes 33, respectively. The insulator 30 comprises three second posts 34 and two holding arms 35 extending rearwardly from a rear face of the insulator 30, the holding arms 35 disposed in two sides of the second posts 34, respectively.

The wire receiving block 40 is mounted to the insulator 30 along a rear-to-front direction. Two ends of the wire receiving block 40 each define a holding slot 42 extending along a front-to-rear direction. The middle portion 41 of the wire receiving block 40 defines three second receiving holes 410 extending along the front-to-rear direction. The holding arms 35 are received in the holding slots 42, respectively. The second posts 34 are received in the second receiving holes 410, respectively. Each of an upper face and a lower face of the wire receiving block 40 comprises a plurality of insulative ribs 411 and a plurality of wire receiving slots 412 formed by the insulative ribs 411. The wire receiving slots 412 are used for receiving a plurality of wires, respectively.

Figure 6:
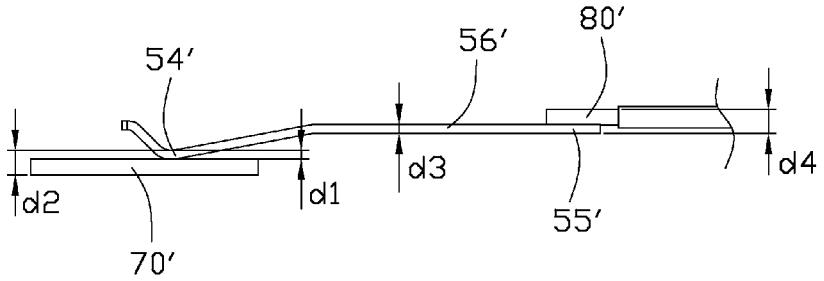
FIG. 6 is a schematic diagram of a conventional terminal cooperating with a wire and a mating terminal in a prior art design.

FIG. 6 shows a terminal of an electrical connector mating with a mating terminal of a mating connector and a wire 80' according to prior art. When the electrical connector is working, an engaging portion 54' of the terminal will be mated with the mating terminal 70' and a soldering portion 55' of the terminal will be soldered with the wire 80'. A dimension of the engaging portion 54' in the thickness direction is d1 when the engaging portion 54' is not mated with the mating terminal 70'. A combined dimension of the engaging portion 54' and the mating terminal 70' in the thickness direction is d2 when the engaging portion 54' is mated with the mating terminal 70'. A dimension of the soldering portion 55' in the thickness direction is d3 when the soldering portion 55' is not soldered with the wire 80'. A combined dimension of the soldering portion 55' and the wire 80' in the thickness direction is d4 when the soldering portion 55' is soldered with the wire 80'. Here, d1 is substantially equal to d3. The relationship between characteristic impedance and a dimension of a terminal is as follow:

$$Z_o = \left[120 \Big/ (Er)^{\frac{1}{2}}\right] \times [\ln(2 \times S/d)]$$

$Z_o$ the characteristic impedance, Er is the dielectric constant, S is a distance between adjacent conductors, and d is a dimension of a conductor.

As the above formula indicates, if an effective compensation of the characteristic impedance of a conductor cannot be achieved by adjusting the dielectric constant or a distance of the adjacent conductors, it might be achieved by merely adjusting a dimension of the conductor. When the other parameters are constants, the characteristic impedance will be inversely proportional to a dimension of the conductor. When a conductor has large variation in dimension along different portions thereof, the characteristic impedance of the conductor will have an abrupt change and the transmission of the signal will be unstable. So, when one end of the terminal is mated with the mating terminal 70' and the other end of the terminal is soldered with the wire 80' in a prior art, the characteristic impedance of the terminal will have an abrupt change. The characteristic impedance of the engaging portion 54' is smaller than the characteristic impedance of the middle portion 56', and the characteristic impedance of the soldering portion 55' is also smaller than the characteristic impedance of the middle portion 56'.

Figure 7:
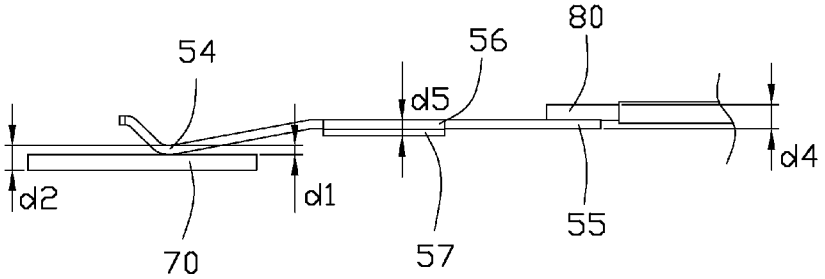
FIG. 7 is a schematic diagram of a terminal of the present invention cooperating with the wire and the mating terminal.

FIG. 7 shows a terminal of an electrical connector 10 mated with a mating terminal and soldered with a wire in accordance with the present invention. The terminal comprises two prominence 57 bent downwardly from two sides of the middle portion 56, respectively, to increase a dimension of the middle portion 56. When the electrical connector 10 is working, an engaging portion 54 of the terminal will be mated with the mating terminal 70 and a soldering portion 55 of the terminal will be soldered with the wire 80. A dimension of the engaging portion 54 in the thickness direction is d1 when the engaging portion 54 is not mated with the mating terminal 70. A combined dimension of the engaging portion 54 and the mating terminal 70 in the thickness direction is d2 when the engaging portion 54 is mated with the mating terminal 70. A dimension of the soldering portion 55 in the thickness direction is d3 when the soldering portion 55 is not soldered with the wire 80. A combined dimension of the soldering portion 55 and the wire 80 in the thickness direction is d4 when the soldering portion 55 is soldered with the wire 80. d1 is substantially equal to d3. A dimension of the middle portion 56 in the thickness direction is d3 when the prominences 57 are not formed. A dimension of the middle portion 56 and the prominences 57 in the thickness direction is d5 when the prominences 57 are formed. Here, d5 is substantially equal to d2 or d4. This avoids characteristic impedance mismatch.

In contrast to the prior art, because the prominences are formed in the middle portion 56, a dimension of the middle portion 56 is increased. When the electrical connector is working, the engaging portion 54 will be mated with the mating terminal 70 and the soldering portion 55 will be soldered with the wire 80. The d5 of the middle portion 56 and the prominences 57 in the thickness direction is substantially equal to the d2 of the engaging portion 54 and the mating terminal 70 in the thickness direction. The d5 of the middle portion 56 and the prominences 57 in the thickness direction is substantially equal to the d4 of the soldering portion 55 and the wire 80 in the thickness direction. This avoids the characteristic impedance of the terminal from having an abrupt change when the electrical connector is working, and this also makes the transmission of the signal stable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a mating port for mating with another connector, and a connecting port for connecting to a conductive part;

a plurality of contacts retained in the housing, each of said contacts stamped from sheet metal having a thickness thereof, each of said contacts having a contacting section in the mating port, a tail section in the connecting port, and a retaining section therebetween; wherein a cross-sectional area around the retaining section is larger than corresponding cross-sectional areas in both the contacting section and the tail section, and a dimension along a thickness direction around the retaining section is larger than corresponding dimensions along the thickness direction in both the contacting section and the tail section: wherein the dimension in the thickness direction around the retaining section is at least twice that around either the contacting section or the tail section; wherein the retaining section is equipped with a pair of prominences, respectively on two sides, laterally facing to each other to form a larger cross-sectional area and a larger dimension in the thickness direction than those in the contacting section and the tail section; wherein the cross-sectional area around the retaining section is of U-shaped configuration with a gap between main portions of two opposite arms of the U-shaped configuration in a transverse direction, said gap having a width dimension in said transverse direction and said width dimension being similar to a thickness of the contact; wherein the dimension in the thickness direction around the retaining section is similar to a sum of the dimensions of the contacting section and a mating terminal of said another connector in the thickness direction or a sum of the dimensions of the tail section and the conductive part in the thickness direction.

2. The electrical connector as claimed in claim 1, wherein the prominences are split from remaining portions of the retaining section each with a pair of slits on two ends in a front-to-back direction so as to bend closer to each other with said gap therebetween.

3. The electrical connector as claimed in claim 2, wherein said gap is filled with the housing via an insert molding process.

4. The electrical connector as claimed in claim 2, wherein said contacts are arranged in two rows with the corresponding U-shaped configurations facing toward each other in a symmetrical manner.

5. The electrical connector as claimed in claim 1, wherein the connecting part is a cable.

6. The electrical connector as claimed in claim 1, wherein the dimension in the thickness direction around the retaining section is twice that around either the contacting section or the tail section.

7. An electrical connector comprising:

an insulative housing defining a mating port for mating with another connector, and a connecting port for connecting to a conductive part;

a plurality of contacts retained in the housing, each of said contacts stamped from sheet metal having a thickness thereof, each of said contacts having a contacting section in the mating port, a tail section in the connecting port, and a retaining section therebetween; wherein a cross-sectional area around the retaining section is larger than corresponding cross-sectional areas in both the contacting section and the tail section, and a dimension along a thickness direction around the retaining section is larger than corresponding dimensions along the thickness direction in both the contacting section and the tail section: wherein the dimension in the thickness direction around the retaining section is at least twice that around either the contacting section or the tail section; wherein the retaining section is equipped with a pair of prominences, respectively on two sides, laterally facing to each other to form a larger cross-sectional area and a larger dimension in the thickness direction than those in the contacting section and the tail section; wherein the cross-sectional area around the retaining section is of U-shaped configuration with a gap between main portions of two opposite arms of the U-shaped configuration in a transverse direction, said gap having a width dimension in said transverse direction and said width dimension being similar to a thickness of the contact; wherein the prominences are split from remaining portions of the retaining section each with a pair of slits on two opposite ends in a front-to-back direction so as to bend closer to each other with said gap therebetween, and each of said slits extends in said transverse direction.

* * * * *